US010943720B2

(12) United States Patent
Mahajan et al.

(10) Patent No.: US 10,943,720 B2
(45) Date of Patent: Mar. 9, 2021

(54) SOLENOID INCLUDING ARMATURE ANTI-ROTATION STRUCTURE

(71) Applicant: HONEYWELL INTERNATIONAL INC., Morris Plains, NJ (US)

(72) Inventors: Deepak Pitambar Mahajan, Karnataka (IN); Kevin Allan Kingsley Jones, Chandler, AZ (US); Varun Anand, Karnataka (IN); Govind Yadav, Karnataka (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 185 days.

(21) Appl. No.: 16/101,702

(22) Filed: Aug. 13, 2018

(65) Prior Publication Data

US 2020/0051723 A1 Feb. 13, 2020

(51) Int. Cl.

| | |
|---|---|
| ***H01F 3/00*** | (2006.01) |
| ***H01F 7/16*** | (2006.01) |
| ***H01F 7/08*** | (2006.01) |
| ***H01F 7/18*** | (2006.01) |
| *H01F 7/126* | (2006.01) |
| *H01F 7/128* | (2006.01) |
| *H01F 7/06* | (2006.01) |

(52) U.S. Cl.

CPC ..... *H01F 7/1607* (2013.01); *H01F 7/081* (2013.01); *H01F 7/18* (2013.01); *H01F 7/126* (2013.01); *H01F 7/128* (2013.01); *H01F 2007/062* (2013.01)

(58) Field of Classification Search

CPC ..... H01F 14/041; H01F 19/03

USPC ..... 251/129.15

See application file for complete search history.

(56) References Cited

U.S. PATENT DOCUMENTS

| | | | | |
|---|---|---|---|---|
| 2,820,604 A * | 1/1958 | Ray | F16K 31/02 251/129.16 |
| 3,510,814 A | 5/1970 | Nordfors | |
| 3,743,987 A * | 7/1973 | Yost | H01F 7/145 335/228 |
| 4,055,823 A | 10/1977 | Andersen | |
| 4,327,344 A * | 4/1982 | Luckenbach | H01F 7/124 335/253 |

(Continued)

FOREIGN PATENT DOCUMENTS

| | | |
|---|---|---|
| DE | 102005051177 A1 | 5/2007 |
| DE | 102015224152 B3 | 3/2017 |

(Continued)

*Primary Examiner* — Alexander Talpalatski

(74) *Attorney, Agent, or Firm* — Lorenz & Kopf, LLP

(57) ABSTRACT

A solenoid actuator includes a housing assembly, a bobbin assembly, a coil, an armature, and an anti-rotation structure. The bobbin assembly is disposed at least partially within the housing assembly and includes a return pole and a yoke. The yoke has an inner surface that defines an armature cavity. The coil is disposed within the housing assembly and is wound around at least a portion of the bobbin assembly. The armature is disposed within the armature cavity and is axially movable relative to the yoke. The anti-rotation structure is disposed within the housing assembly and engages at least a portion of the armature. The armature and the anti-rotation structure each have at least one feature formed thereon that mate with each other and thereby prevent rotation of the armature.

19 Claims, 5 Drawing Sheets

(56) References Cited

U.S. PATENT DOCUMENTS

| | | | | |
|---|---|---|---|---|
| 4,454,934 | A * | 6/1984 | Deveney | F16K 35/16 188/171 |
| 4,830,333 | A | 5/1989 | Watson | |
| 6,392,516 | B1 | 5/2002 | Ward et al. | |
| 6,655,612 | B2 | 12/2003 | Oliver | |
| 6,779,776 | B2 * | 8/2004 | Suilmann | F15B 13/044 251/129.15 |
| 6,874,706 | B2 | 4/2005 | Hanneke et al. | |
| 7,785,224 | B2 | 8/2010 | York et al. | |
| 9,107,999 | B2 * | 8/2015 | Moberg | A61M 5/16831 |
| 9,321,444 | B2 * | 4/2016 | Ganzel | B60T 8/4081 |
| 9,324,488 | B2 | 4/2016 | Dayton | |
| 10,539,250 | B2 * | 1/2020 | Mahajan | F16K 1/50 |
| 2003/0080305 | A1 * | 5/2003 | Schafer | H01F 7/1607 251/129.07 |
| 2003/0160200 | A1 * | 8/2003 | Suilmann | F15B 13/044 251/129.18 |
| 2004/0075071 | A1 * | 4/2004 | Braun | F15B 13/0407 251/129.15 |
| 2005/0051142 | A1 | 3/2005 | Zdravkovic et al. | |
| 2006/0184154 | A1 * | 8/2006 | Moberg | A61M 5/14566 604/506 |
| 2008/0308761 | A1 | 12/2008 | Matsumoto | |
| 2009/0072636 | A1 | 3/2009 | Gruden | |
| 2013/0161546 | A1 | 6/2013 | Frippiat et al. | |
| 2014/0265547 | A1 * | 9/2014 | Ganzel | B60T 13/745 303/66 |
| 2015/0061799 | A1 | 3/2015 | Dayton | |
| 2015/0213935 | A1 | 7/2015 | Wernau et al. | |
| 2019/0323623 | A1 * | 10/2019 | Mahajan | F16K 1/34 |

FOREIGN PATENT DOCUMENTS

| | | | |
|---|---|---|---|
| DE | 102015121707 | A1 | 6/2017 |
| EP | 2172949 | A1 | 4/2010 |
| JP | 2017219136 | A | 12/2017 |
| WO | 0033329 | A1 | 6/2000 |
| WO | 2017208684 | A1 | 12/2017 |

* cited by examiner

SOLENOID INCLUDING ARMATURE ANTI-ROTATION STRUCTURE

TECHNICAL FIELD

The present invention generally relates to solenoids, and more particularly relates to a solenoid actuator that includes a robust, wear resistant armature anti-rotation structure.

BACKGROUND

Solenoid actuators are electromechanical devices that convert electrical energy into linear mechanical movement. Solenoid actuators are used in myriad environments and for many applications, and typically includes at least a coil, a magnetically permeable shell or case, and a movable armature.

When the coil is energized, a magnetic field is generated that exerts a force on the movable armature, and moves it to a desired position. In addition, due to non-ideal manufacturing tolerances, an unbalanced concentration of magnetic flux around the periphery of the armature may also occur when the coil is energized. This causes a resultant torque on the armature, urging it to move sideways and to rotate. Armature rotation may also occur when the solenoid actuator experiences vibration.

Regardless of the cause, armature rotation can cause wear of the armature and surrounding components, resulting in debris formation. This debris can get deposited in gaps within the solenoid actuator causing the armature to stick. Thus, many solenoid actuators include anti-rotation features. However, existing armature anti-rotation features rely on metal-to-metal sliding contact. This, too, results in wear. In addition, existing anti-rotation features are not sufficiently robust to withstand relatively high vibration.

Hence, there is a need for a solenoid actuator that includes an armature anti-rotation structure that does not rely on metal-to-metal sliding contact, and that can withstand a relatively high-vibration environment. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a solenoid actuator includes a housing assembly, a bobbin assembly, a coil, an armature, and an anti-rotation structure. The bobbin assembly is disposed at least partially within the housing assembly, and includes a return pole and a yoke. The yoke has an inner surface that defines an armature cavity. The coil is disposed within the housing assembly and is wound around at least a portion of the bobbin assembly. The armature is disposed within the armature cavity and is axially movable relative to the yoke. The anti-rotation structure is disposed within the housing assembly and engages at least a portion of the armature. The armature and the anti-rotation structure each have at least one feature formed thereon that mate with each other and thereby prevent rotation of the armature.

In another embodiment, a solenoid actuator includes a housing assembly, a bobbin assembly, a coil, an armature, and an anti-rotation structure. The bobbin assembly is disposed at least partially within the housing assembly, and includes a return pole and a yoke. The yoke has an inner surface that defines an armature cavity. The coil is disposed within the housing assembly and is wound around at least a portion of the bobbin assembly. The armature is disposed within the armature cavity and is axially movable relative to the yoke. The anti-rotation structure is disposed within the housing assembly and engages at least a portion of the armature. The anti-rotation structure at least partially comprises a material selected from the group that includes a thermoplastic polymer material, polytetrafluoroethylene (PTFE), and fluorinated ethylene propylene (FEP). The armature and the anti-rotation guide each have at least one feature formed thereon that mate with each other and thereby prevent rotation of the armature.

Furthermore, other desirable features and characteristics of the solenoid actuator will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
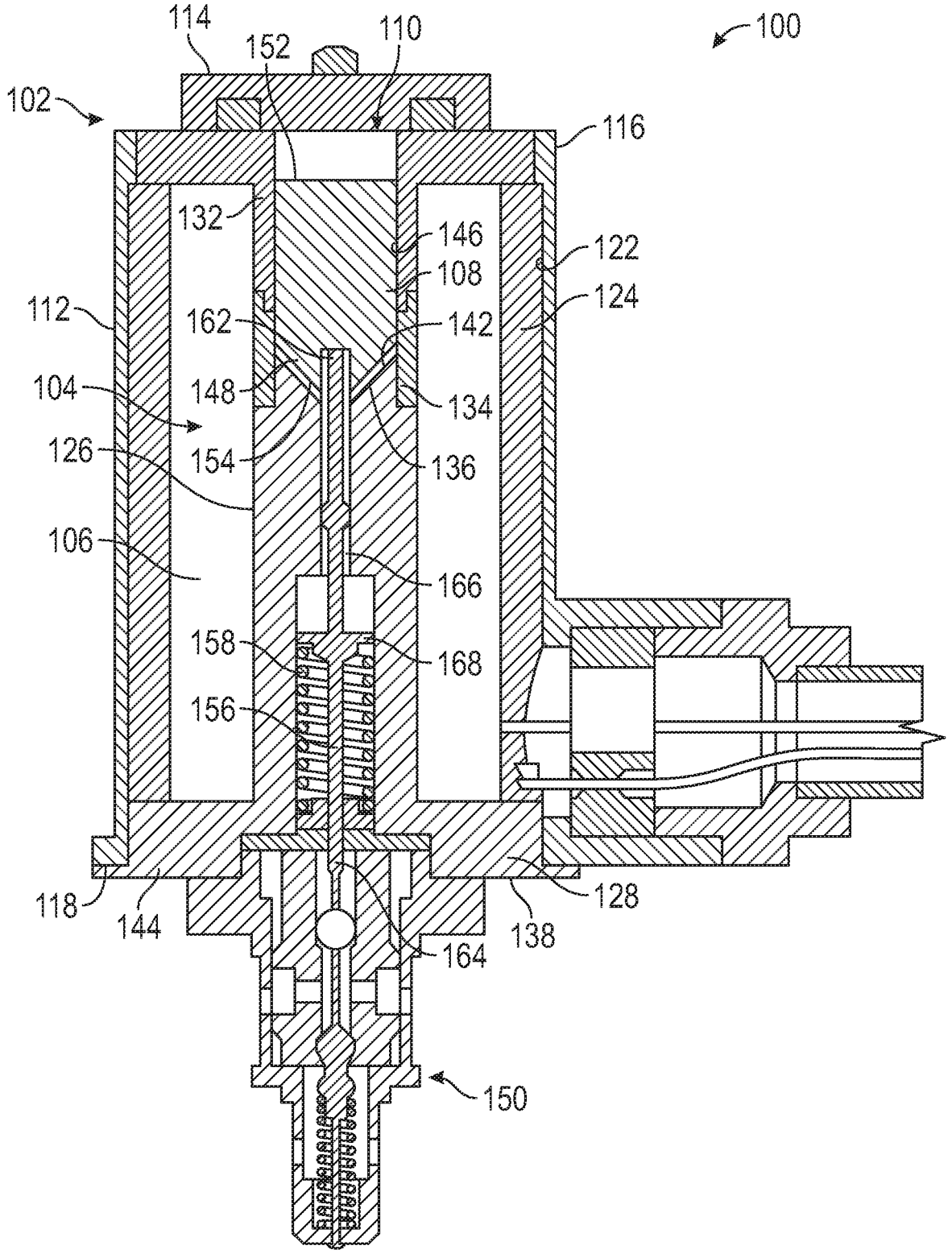
FIG. 1 depicts a cross section view of one exemplary embodiment of a solenoid actuator.

Referring to FIG. 1, a cross section view of one exemplary embodiment of a high temperature solenoid actuator 100 is depicted. The solenoid actuator 100 includes at least a housing assembly 102, a bobbin assembly 104, a coil 106, an armature 108, and an anti-rotation structure 110. The housing assembly 102 includes a housing 112 and a cover plate 114. The housing 112 is configured to include a housing first end 116, a housing second end 118, and an inner surface 122 that defines a housing cavity 124. The housing 112 may comprise any one of numerous materials having a relatively high magnetic permeability such as, for example, magnetic steel. The housing 112, in addition to having a plurality of components disposed therein, provides a flux path, together with the bobbin assembly 104, for magnetic flux that the coil 106 generates when it is electrically energized. The cover plate 114 is coupled to the housing first end 116, and may also comprise any one of numerous materials having a relatively high magnetic permeability.

The bobbin assembly 104 includes at least a bobbin 126, a return pole 128, a yoke (or stop) 132, and an interrupter 134. The return pole 128 is fixedly coupled to the housing second end 118 and extends into the housing cavity 124. The return pole 128 preferably comprises a material having a relatively high magnetic permeability. The return pole 128, together with the housing 102, the armature 108, and the yoke 132 provides a magnetic flux path for the magnetic flux that is generated by the coil 106 when it is energized. The return pole 128 includes a return pole first end 136 and a return pole second end 138. The return pole first end 136 extends into the housing cavity 124. The return pole first end 136 is surrounded by, or at least partially surrounded by, the coil 106, and defines an armature seating surface 142. The return pole second end 138 defines a flange portion 144 that is disposed within the housing cavity 124, and on which the bobbin 126 is disposed.

The interrupter 134 is disposed between the return pole 128 and the yoke 132. The interrupter 134 diverts the magnetic flux in the working air gap when the coil 106 is energized. The interrupter 134 may be manufactured from various non-magnetic materials, such as brass or non-magnetic steel (e.g. CRES 302).

The coil 106 is disposed within the housing 112 and is adapted to be electrically energized from a non-illustrated electrical power source. As noted above, when it is energized, the coil 106 generates magnetic flux. In the depicted embodiment, the coil 106 is wound around a portion of the bobbin 126, and comprises a relatively fine gauge (e.g., 30-38 AWG) magnet wire, though larger gauge magnet wire could also be used. The magnet wire may be fabricated from any one of numerous conductive materials including, but not limited to, copper, aluminum, nickel, and silver. Although only a single coil 106 is depicted in FIG. 1, it will be appreciated that the solenoid actuator 100 could be configured with two or more coils, if needed or desired.

The armature 108 is disposed (at least partially) within the yoke 132. More specifically, the yoke 132 has an inner surface 146 that defines an armature cavity. The armature 108 is disposed (at least partially) within the armature cavity and is axially movable relative to the yoke 132. The depicted armature 108 includes an armature first end 148 and an armature second end 152, and preferably comprises a material having a relatively high magnetic permeability. The armature first end 148 is at least partially surrounded by the coil 106 and defines a return pole engagement surface 154. As noted previously, the armature 108, together with the solenoid housing 112, the return pole 128, and the yoke 132, provides a magnetic flux path for the magnetic flux that is generated by the coil 106 when it is energized. This results in axial movement of the armature 108 within the housing 112 between a first position and a second position. The armature 108 preferably comprises a metallic material, such as, for example, a low carbon steel. It will be appreciated, however, that in some embodiments, portions of the armature 108 may be coated with a non-metallic material, such as, for example, a thermoplastic polymer, a polytetrafluoroethylene (PTFE), or a fluorinated ethylene propylene (FEP) material.

The depicted solenoid actuator 100 additionally includes an actuation rod 156 and a spring 158. The actuation rod 156 includes a first end 162 and a second end 164. The actuation rod 156 is coupled, via its first end 162, to the armature 108, and extends through a return pole bore 166 that extends between the return pole first end 136 and the return pole second 138. The actuation rod 156 also extends from the housing 102 to its second end 164. The second end 164 is coupled to a component 150, such as, for example, a valve, that is to be actuated by the solenoid actuator 100. It will be appreciated that the actuation rod 156 may be coupled to the armature 108 using any one of numerous techniques. In the depicted embodiment, however, the actuation rod 156 is coupled to the armature 108 via clearance fit.

The spring 158 is disposed within the housing 102 and is configured to supply a bias force to the armature 108 that urges the armature 108 toward the first position. The spring 158 may be variously disposed to implement this functionality. In the depicted embodiments, the spring 158 is disposed within the return pole bore 166 and engages the return pole 128 and lands 168 that are formed on or coupled to the actuation rod 156. Thus, the spring 158 supplies the bias force to the armature 108 via the actuation rod 156. In other embodiments, the spring 158 may be variously disposed within the housing 102 to supply the bias force to the armature 108.

Turning now to the anti-rotation structure 110. It is disposed within the housing 102 and engages at least a portion of the armature 108. Although the anti-rotation structure 110 is illustrated using a functional block in FIG. 1, it should be noted that the anti-rotation structure 110 and the armature 108 each have at least one feature formed thereon that mate with each other and thereby prevent any armature rotation that may occur when the coil 106 is energized, and/or if the solenoid actuator 100 is exposed to vibration. It will be appreciated that the anti-rotation structure 110 and the armature 108 may be variously configured to implement this function. Some example configurations will now be described. Before doing so, however, it is noted that the anti-rotation structure 110 at least partially comprises a thermoplastic polymer, a polytetrafluoroethylene (PTFE), or a fluorinated ethylene propylene (FEP) material. For example, it may fully comprise one of these materials, or it may comprise a metallic material that is coated, or at least partially coated, with one of these materials.

Figure 2:
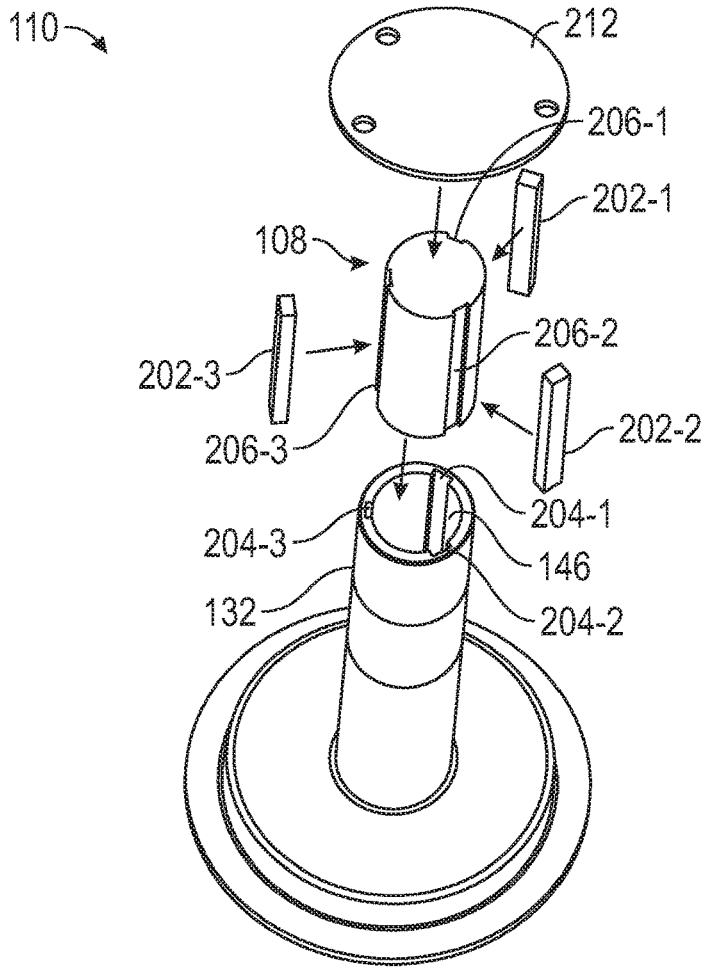
FIGS. 2-4 depict one example embodiment of an anti-rotation structure that may be used to implement the actuator of FIG. 1.
Figure 3:
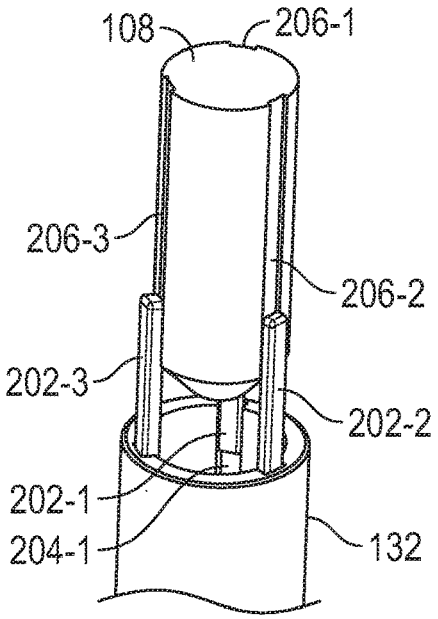
Figure 4:
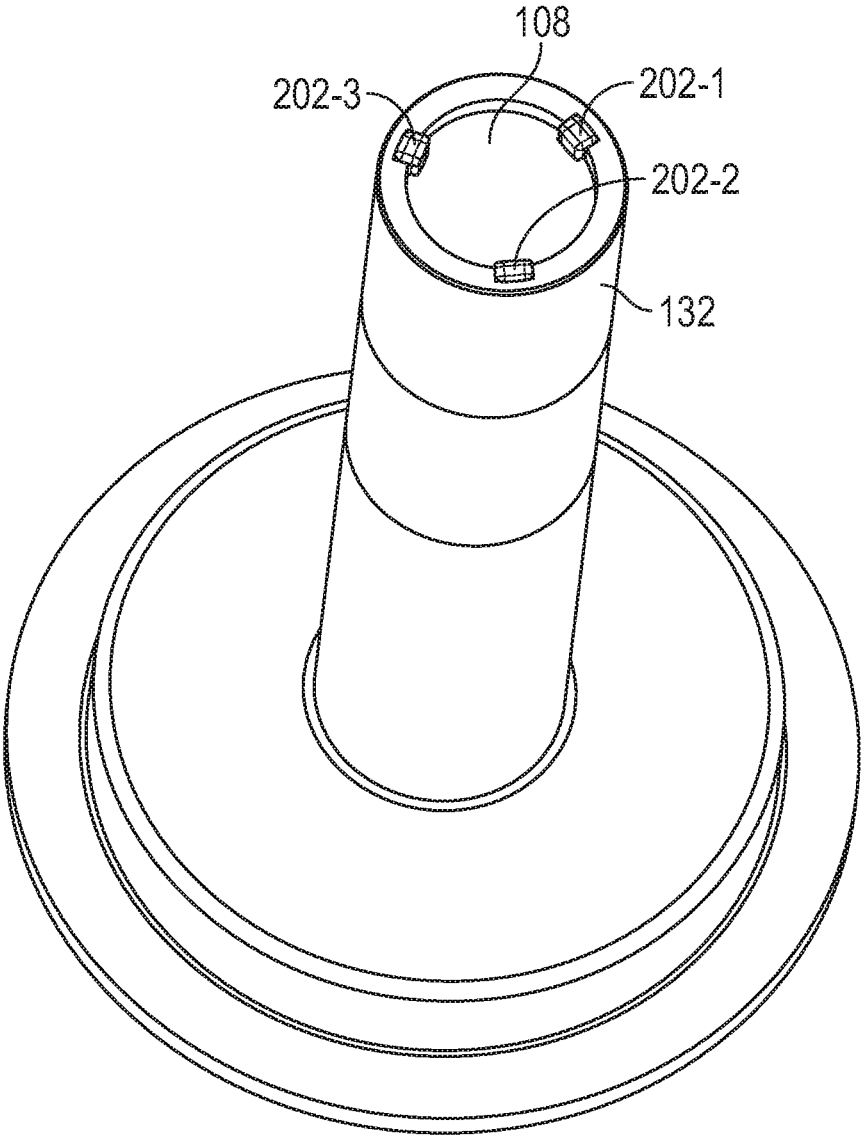

Referring first to FIGS. 2-4, in this embodiment the anti-rotation structure 110 comprises a plurality of strips 202 (e.g., 202-1, 202-2, 202-3), and each strip is disposed in one of a plurality of grooves that are formed on the yoke and the armature 108. In particular, the inner surface 146 of the yoke 132 has a plurality of first grooves 204 (e.g., 204-1, 204-2, 204-3) formed therein, and the armature 108 has a plurality of second grooves 206 (e.g., 206-1, 206-2, 206-3) formed on its outer surface 208. In the depicted embodiment, there are three first grooves 204, and three second grooves 206. It will be appreciated, however, that this is merely exemplary, and that other numbers of first and second grooves 204, 206 (and thus strips 202) could be included. For example, there may be one or more first grooves 204 and one or more second grooves 206, and thus one or more strips 202.

Regardless of the specific number of first and second grooves 204, 206, and as shown most clearly in FIGS. 3 and 4, each strip 202 is partially disposed in one of the first grooves 204 and in one of the second grooves 206. In addition, and as FIG. 2 also depicts, with this embodiment the anti-rotation structure 110 may additionally include an anti-rotation plate structure 212. The anti-rotation plate structure 212, if included, is disposed between the yoke 132 and the cover plate 114.

Figure 5A:
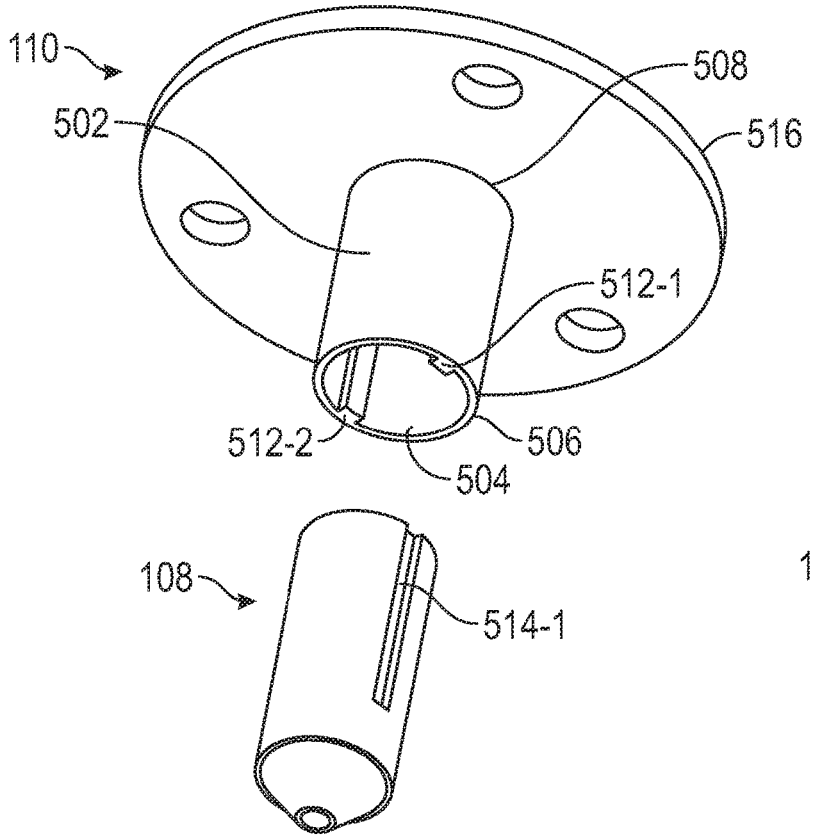
FIGS. 5A, 5B, and 6 depict another example embodiment of an anti-rotation structure that may be used to implement the actuator of FIG. 1.
Figure 6:
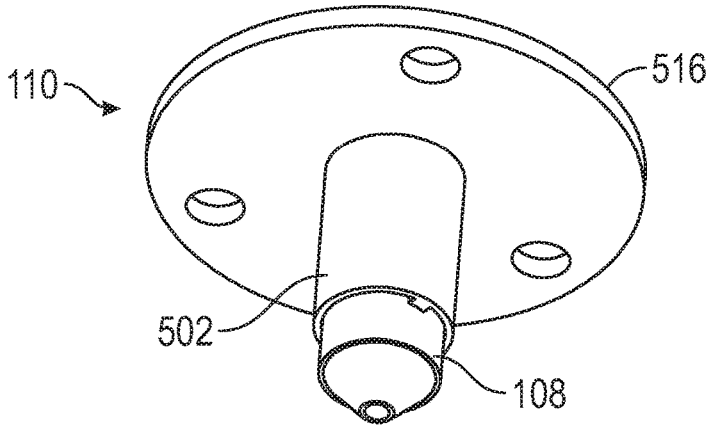

It should be noted that at least the strip(s) 202 is (are) formed of a thermoplastic polymer, a polytetrafluoroethylene (PTFE), or a fluorinated ethylene propylene (FEP) material. In some embodiments, however, one or more of the first and second grooves 204, 206 may be coated with the thermoplastic polymer, a polytetrafluoroethylene (PTFE), or a fluorinated ethylene propylene (FEP) material In another embodiment, which is depicted in FIGS. 5A and 6, the anti-rotation structure 110 comprises a cylindrical portion 502 having an inner surface 504, a first end 506, and a second end 508. The inner surface 504 of the cylindrical portion 504 has a plurality of ribs 512 (e.g., 512-1, 512-2) formed thereon and that extend radially inwardly. In this embodiment, the armature 108 has a plurality of grooves 514 (e.g., 514-1, 514-2 (not visible)) formed on its outer surface 208. In the depicted embodiment, there are two ribs 512, and two grooves 514. It will be appreciated, however, that this is merely exemplary, and that other numbers of ribs 512 and grooves 514 could be included. Preferably, however, there is at least on rib 512 and one groove 514.

Regardless of the specific number of ribs 512 and grooves 514, and as shown most clearly in FIG. 6, the cylindrical portion 502 surrounds at least a portion of the armature 108, and each of the ribs 512 is at least partially disposed in a different one of grooves 514. In addition, with this embodiment the anti-rotation structure 110 may additionally include a flange 516. The flange 516, if included, is coupled to, and extends radially from, the second end 508 of the cylindrical portion 502 and, when installed, is disposed between the yoke 132 and the cover plate 114.

Figure 5B:
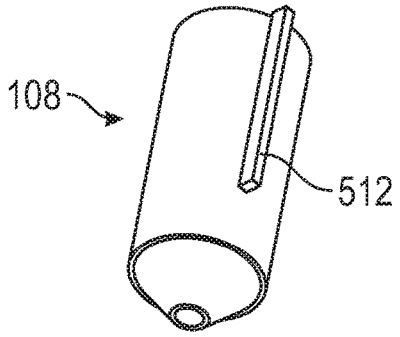

In the embodiment depicted in FIGS. 5A and 6, the one or more ribs 512 are formed on the cylindrical portion 502 and the one or more grooves 514 are formed on the outer surface 208 of the armature 108. With quick reference to FIG. 5B, it is seen that in other embodiments the one or more ribs 512 may instead be formed on the outer surface 208 of the armature 108. In such embodiments, the one or more grooves 514 are formed on the inner surface 504 of the cylindrical portion 502. Here again, each of the ribs 512 is at least partially disposed in a different one of grooves 514.

Figure 7:
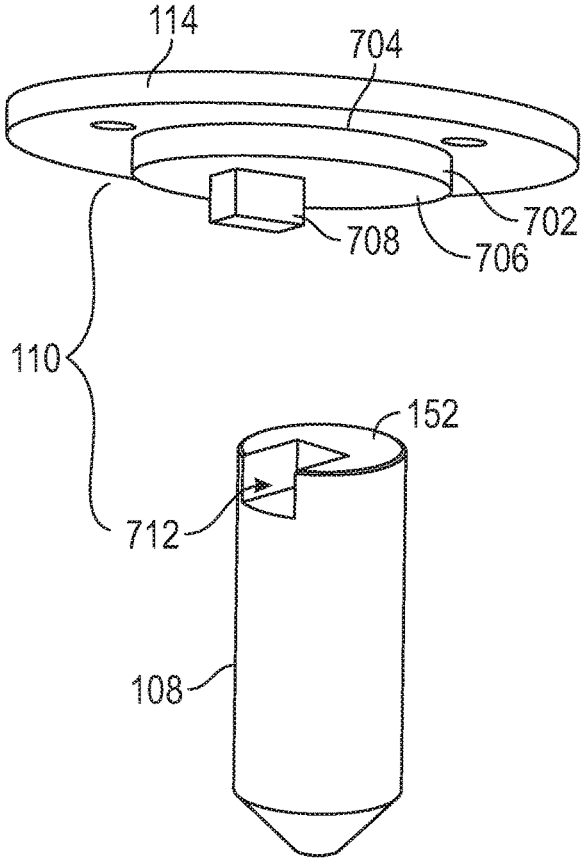
FIG. 7 depicts another example embodiment of an anti-rotation structure that may be used to implement the actuator of FIG. 1.

Turning now to FIG. 7, in another embodiment, the anti-rotation structure 110 comprises a cylindrical plate 702 having a first side 704 and a second side 706. The second the second side 706 of the cylindrical plate 702 has a projection 708 that extends perpendicularly therefrom. When assembled, the projection 708 is disposed at least partially in a slot 712 that is formed in the second end 152 of the armature 108.

As may be appreciated, the projection 708 may be centered or off-centered, and may extend across only a portion or the entire diameter of the second side 706 of the cylindrical plate 702. In addition, the slot 712 may extend partially or entirely across the second end 152 of the armature 108.

Figure 8:
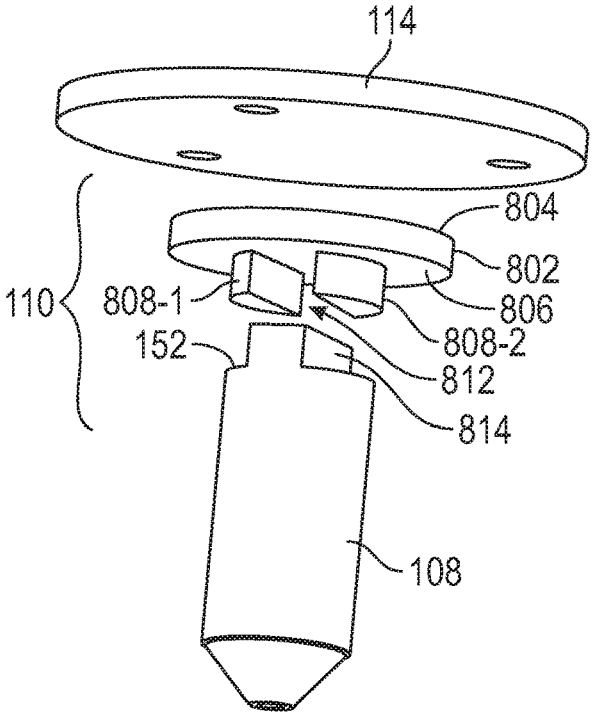
FIG. 8 depicts another example embodiment of an anti-rotation structure that may be used to implement the actuator of FIG. 1.

In yet another embodiment, which is depicted in FIG. 8, the anti-rotation structure 110 also comprises a cylindrical plate 802 having a first side 804 and a second side 806. In this embodiment, however, the second side 806 of the cylindrical plate 802 has a plurality of protuberances—a first protuberance 808-1 and a second protuberance 808-2—extending perpendicularly therefrom. The first and second protuberances 808-1, 808-2 are spaced apart from each other to define a slot 812, and a projection 814 that extends perpendicularly from the second end 152 of the armature 108 is disposed at least partially within the slot 812.

As may be appreciated, the protuberances 808 may be centered or off-centered, and may extend across only a portion or the entire diameter of the second side 806 of the cylindrical plate 802. In addition, the projection 814 may extend partially or entirely across the second end 152 of the armature 108.

The solenoid actuator 100 disclosed herein includes an armature anti-rotation structure 110 that comprises a non-metallic material, such as a thermoplastic polymer, a polytetrafluoroethylene (PTFE), or a fluorinated ethylene propylene (FEP), and thus not rely on metal-to-metal sliding contact. In addition, the anti-rotation structure 110 that can withstand a relatively high-vibration environment.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A solenoid actuator, comprising:

a housing assembly;

a bobbin assembly disposed at least partially within the housing assembly, the bobbin assembly including a return pole and a yoke, the yoke having an inner surface that defines an armature cavity;

a coil disposed within the housing assembly and wound around at least a portion of the bobbin assembly;

an armature disposed within the armature cavity and axially movable relative to the yoke; and an anti-rotation structure disposed within the housing assembly and engaging at least a portion of the armature, wherein:

the armature includes a first end and a second end;

the second end of the armature has a projection extending perpendicularly therefrom;

the anti-rotation structure comprises a cylindrical plate having a first side and a second side;

the second side of the cylindrical plate has a first protuberance and a second protuberance, each extending perpendicularly from the second side of the cylindrical plate;

the first and second protuberances are spaced apart from each other to define a slot; and the projection is disposed at least partially within the slot.

2. The solenoid actuator of claim 1, wherein the anti-rotation structure at least partially comprises a material selected from the group that includes a thermoplastic polymer material, polytetrafluoroethylene (PTFE), and fluorinated ethylene propylene (FEP).

3. A solenoid actuator, comprising:

a housing;

a cover plate coupled to the housing;

a bobbin assembly disposed at least partially within the solenoid housing, the bobbin assembly including a return pole and a yoke, the yoke having an inner surface that defines an armature cavity;

a coil disposed within the solenoid housing and wound around at least a portion of the bobbin assembly;

an armature disposed within the armature cavity and axially movable relative to the yoke; and an anti-rotation structure disposed within the housing and engaging at least a portion of the armature, the anti-rotation structure at least partially comprising a material selected from the group that includes a thermoplastic polymer material, polytetrafluoroethylene (PTFE), and fluorinated ethylene propylene (FEP), wherein:

the armature includes a first end and a second end;

the second end of the armature has a projection extending perpendicularly therefrom;

the anti-rotation structure comprises a cylindrical plate having a first side and a second side;

the second side of the cylindrical plate has a first protuberance and a second protuberance, each extending perpendicularly from the second side of the cylindrical plate;

the first and second protuberances are spaced apart from each other to define a slot; and the projection is disposed at least partially within the slot.

4. The solenoid actuator of claim 3, wherein at least a portion of the armature is coated with the material selected from the group that includes a thermoplastic polymer material, polytetrafluoroethylene (PTFE), and fluorinated ethylene propylene (FEP).

5. The solenoid actuator of claim 1, wherein the housing assembly comprises:

a housing having a housing first end, a housing second end, and an inner surface that defines a cavity; and a cover plate coupled to the housing first end.

6. The solenoid actuator of claim 5, wherein the housing and cover each comprise a magnetically permeable material.

7. The solenoid actuator of claim 1, wherein:

the bobbin assembly additionally includes a bobbin;

the return pole includes a return pole first end and a return pole second end;

the return pole first end is at least partially surrounded by the coil and defines an armature seating surface; and the return pole second end defines a flange portion that is disposed within the housing, and on which the bobbin is disposed.

8. The solenoid actuator of claim 1, further comprising:

an interrupter disposed between the return pole and the yoke, the interrupter comprising a non-magnetic material.

9. The solenoid actuator of claim 1, wherein the coil comprises magnet wire.

10. The solenoid actuator of claim 1, wherein:

the armature includes an armature first end and an armature second end; and the armature first end is at least partially surrounded by the coil and defines a return pole engagement surface.

11. The solenoid actuator of claim 1, wherein:

the armature comprises a magnetically permeable material; and at least portions of the armature are coated with a non-metallic material.

12. The solenoid actuator of claim 1, further comprising:

an actuation rod disposed within an extending from the housing assembly, the actuation rod having a first end and a second end, the first end coupled to the armature, the second end coupled to a component; and a spring disposed within the housing supplying a bias force to the armature.

13. The solenoid actuator of claim 3, wherein the housing and cover each comprise a magnetically permeable material.

14. The solenoid actuator of claim 3, wherein:

the bobbin assembly additionally includes a bobbin;

the return pole includes a return pole first end and a return pole second end;

the return pole first end is at least partially surrounded by the coil and defines an armature seating surface; and the return pole second end defines a flange portion that is disposed within the housing, and on which the bobbin is disposed.

15. The solenoid actuator of claim 3, further comprising:

an interrupter disposed between the return pole and the yoke, the interrupter comprising a non-magnetic material.

16. The solenoid actuator of claim 3, wherein the coil comprises magnet wire.

17. The solenoid actuator of claim 3, wherein:

the armature includes an armature first end and an armature second end; and the armature first end is at least partially surrounded by the coil and defines a return pole engagement surface.

18. The solenoid actuator of claim 3, wherein:

the armature comprises a magnetically permeable material; and at least portions of the armature are coated with a non-metallic material.

19. The solenoid actuator of claim 3, further comprising:

an actuation rod disposed within an extending from the housing assembly, the actuation rod having a first end and a second end, the first end coupled to the armature, the second end coupled to a component; and a spring disposed within the housing supplying a bias force to the armature.

* * * * *